US006394886B1

(12) United States Patent
Chen et al.

(10) Patent No.: US 6,394,886 B1
(45) Date of Patent: May 28, 2002

(54) CONFORMAL DISK HOLDER FOR CMP PAD CONDITIONER

(75) Inventors: Wen-Ten Chen, Junghe; Yao-Hsiang Liang, Kaohsiung; Chih-I Peng; Yu-Chia Chang, both of Hsin-Chu, all of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/975,539

(22) Filed: Oct. 10, 2001

(51) Int. Cl.[7] ..... B24B 47/02
(52) U.S. Cl. ..... 451/398; 451/56; 451/443
(58) Field of Search ..... 451/56, 443, 405, 451/398, 285, 286, 288, 365, 388, 360, 363

(56) References Cited

U.S. PATENT DOCUMENTS 4,313,284 A * 2/1982 Walsh ..... 451/288
5,357,716 A * 10/1994 Kishida et al. ..... 451/390
5,582,534 A * 12/1996 Shendon et al. ..... 451/41
5,938,884 A * 8/1999 Hoshizaki et al. ..... 156/345
6,196,903 B1 * 3/2001 Kimura ..... 451/285
6,299,199 B1 * 3/2001 Gurusamy et al. ..... 451/56
6,217,429 B1 * 4/2001 Hoey ..... 451/443
6,280,309 B1 * 8/2001 Van Osenbruggen et al. . 451/15

* cited by examiner

*Primary Examiner*—Joseph J. Hail, III
*Assistant Examiner*—Hadi Shakeri
(74) *Attorney, Agent, or Firm*—Randy W. Tung

(57) ABSTRACT

A conformal disk holder for holding a rotating disk against a surface of a polishing pad is described. The conformal disk holder can be used for any polishing apparatus, but is particularly suited for use in a CMP pad conditioning disk. The conformal disk holder is constructed by a cover member, a flexural plate member and a base member. The flexural plate member has a center protrusion with a downwardly facing convex surface for intimately engaging an upwardly facing concave surface on a center protrusion of the base member. The intimate engagement between the convex surface and the concave surface allows at least a 5° tilt of the base member from a horizontal plane, and preferably allows a tilt between about 5° and about 30°.

20 Claims, 4 Drawing Sheets

CONFORMAL DISK HOLDER FOR CMP PAD CONDITIONER

FIELD OF THE INVENTION

The present invention generally relates to a disk holder for holding a rotating disk against a surface and more particularly, relates to a conformal disk holder for holding a CMP pad conditioning disk against the surface of a polishing pad for conducting a CMP pad conditioning process.

BACKGROUND OF THE INVENTION

Apparatus for polishing thin, flat semi-conductor wafers is well known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1*a*) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1*a* is a conditioner arm 32 which is equipped with a rotating conditioner disc 34. The conditioner arm 332 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results form a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($Al_3O_2$) may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity.

Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

While the pad conditioning process improves the consistency and lifetime of a polishing pad, a conventional conditioning disk is frequently not effective in conditioning a pad surface after repeated usage. A conventional conditioning disk for use in pad conditioning is shown in FIGS. 2A and 2B.

Referring now to FIG. 2A, wherein a perspective view of a CMP publishing station 42 is shown. The polishing station 42 consists of a conditioning head 52, a polishing pad 28, and a slurry delivery arm 54 positioned over the polishing pad. The conditioning head 52 is mounted on a conditioning arm 58 which is extended over the top of the polishing pad 28 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

The conditioning disk 68, shown in FIG. 2B is formed by embedding or encapsulating diamond particles 50 in nickel 56 coated on the surface 70 of a rigid substrate 22. FIG. 2B is a cross-sectional view of a new conditioning disk with all the diamond particles 32 embedded in nickel 34. In the fabrication of the diamond particle conditioning disk 68, a nickel encapsulant 56 is first mixed with a diamond grit which includes diamond particles 50 and then applied to the rigid substrate 22.

The conditioning disk 68 is mounted onto a disk holder, as shown in FIGS. 3A–3C, which is constructed by three structural members, i.e. a cross member 74, a ring member 78 and a holder member 80. The conventional disk holder that is constructed by the three members 74,78 and 80 requires a complicated assembling process when the parts are taken apart during a preventive maintenance procedure. For instance, the three members shown in FIGS. 3A–3C, are held together by a total of sixteen screws and therefore, require as long as two hours for completing a preventive maintenance procedure. Moreover, the original design utilizes the cross member 74 as a flexural member for providing conformability of the conditioning disk to a surface of a polishing pad. The cross member does not have a rigid structure and is prone to various mechanical damages when not used or installed properly. Breakage or fracture of the cross member 74 is frequently encountered which results in substantial down time of the conditioning disk, increased rework rate and reduced yield.

It is therefore an object of the present invention to provide a disk holder for holding a rotating disk against a surface that does not have the drawbacks or shortcomings of the conventional disk holder supplied by the machine manufacturer.

It is another object of the present invention to provide a conformal disk holder for holding a rotating disk intimately against a polishing pad surface.

It is a further object of the present invention to provide a conformal disk holder for holding a CMP pad conditioning disk against a polishing pad surface.

It is another further object of the present invention to provide a conformal disk holder for holding a rotating disk against a surface wherein the disk holder is allowed at least a 5° tilt from a horizontal plane in order to conform to the surface that is being conditioned.

It is still another object of the present invention to provide a conformal disk holder for holding a rotating disk against a surface to be conditioned wherein the disk holder allows a tilt between about 5° and about 30° from a horizontal plane.

It is yet another object of the present invention to provide a conformal disk holder for holding a CMP pad conditioning disk against a polishing pad surface which is effective in following a profile of the polishing pad surface for activating fibers on the pad.

SUMMARY OF THE INVENTION

In accordance with the present invention, a conformal disk holder for holding a rotating disk against a surface to be conditioned is provided.

In a preferred embodiment, a conformal disk holder for holding a rotating disk against a surface to be conditioned can be provided which includes a holder body of circular shape that has a first diameter, a center aperture for accessing a center flexural plate, and a means for connecting to a rotating shaft; a center flexural plate of circular shape that has a second diameter smaller than the first diameter for fitting inside a downwardly protruded edge portion on the holder cover; the center flexural plate is equipped with a center protrusion that has a downwardly facing convex surface and at least three notch openings equally spaced-apart along a peripheral edge of the plate; and a holder base of circular shape that has a first diameter and a center protrusion with an upwardly facing concave surface adapted for intimately engaging the convex surface on the center flexural plate so as to allow at least a 5° tilt of the holder base from a horizontal plane, the holder base further includes at least three locating pins extending upwardly from a top surface of the holder base adapted for engaging the at least three notch openings in the center flexural plate, and means for fastening a disk onto a bottom surface of the holder base.

In the conformal disk holder for holding a rotating disk against a surface to be polished, the concave surface on the holder base allows a tilt between about 5° and about 30° of the holder base from a horizontal plane, and preferably a tilt between about 10° and about 20° of the holder base from a horizontal plane. The conformal disk may further include a CMP conditioning disk mounted to the bottom surface of the holder base. The holder base, the center flexural plate and the holder cover may be fabricated of stainless steel. The downwardly facing convex surface on the center flexural plate and the upwardly facing concave surface on the holder base may have the same curvature. The conformal disk holder may be adapted to follow the contour of a polishing pad surface in a CMP apparatus. The holder cover, the center flexural plate and the holder base are assembled together by mechanical means.

The present invention is further directed to a conformal disk holder for holding a CMP pad conditioning disk which includes a cover member of circular shape that has a first diameter, a center aperture for accessing a flexural plate member, and a means for connecting to a rotating shaft; a flexural plate member of circular shape that has a second diameter smaller than the first diameter for fitting inside a downwardly protruded edge portion on the cover member; the flexural plate member may be equipped with a center protrusion that has a downwardly facing convex surface and at least three notch openings equally spaced-apart along a peripheral edge of the plate; and a base member of circular shape that has a first diameter and a center protrusion with an upwardly facing concave surface adapted for intimately engaging the convex surface on the center flexural plate so as to allow a tilt between about 5° and about 30° of the base member from a horizontal plane, the base member may further include at least three locating pins extending upwardly from a top surface of the base member adapted for engaging the at least three notch openings in the flexural plate member, and means for mounting a conditioning disk onto a bottom surface of the base member.

In the conformal disk holder for holding a CMP pad conditioning disk, the flexural plate member may be equipped with a center portion that has a downwardly facing concave surface, while the base member may have a center protrusion with an upwardly facing convex surface adapted for intimately engaging the concave surface on the center flexural plate. The conformal disk holder may further include a CMP conditioning disk mounted to the bottom surface of the base member. The concave surface of the base member allows a tilt preferably between about 10° and about 20° of the holder base from a horizontal plane. The cover member, the flexural plate member and the base member may be fabricated of stainless steel. The downwardly facing convex surface on the flexural plate member and the upwardly facing concave surface on the base member have the same curvature to allow an intimate engagement. The cover member, the flexural plate member and the base member may be assembled together by mechanical means, such as by screws or bolts.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a conformal disk holder for holding a rotating disk against a surface of a polishing pad wherein a disk mounted to the disk holder is allowed to tilt at least 5° to follow the contour of the surface of the polishing pad. While the present invention conformal disk holder can be used in any type of polishing apparatus, it is particularly suited for using in a CMP apparatus wherein a pad conditioning disk is rotated against a surface of a polishing pad to activate the fiber in the pad surface.

The conformal disk holder for holding a rotating disk against a surface of a polishing pad is constructed by a holder cover of circular shape, a center flexural plate of circular shape having a diameter smaller than the holder cover, and a holder base of circular shape having the same diameter as the holder cover. The center flexural plate is equipped with a center protrusion that has a downwardly facing convex surface and at least three notch openings equally spaced apart along a peripheral edge of the plate. The holder base is equipped with a center protrusion with an upwardly facing concave surface adapted for intimately engaging the convex surface on the center flexural plate so as to allow at least a 5° tilt of the holder base from a horizontal plane. The tilting of the holder base thus allows a disk mounted on the bottom surface of the holder base to follow, conformally, a contour of the surface of the polishing pad.

The position of the concave surface and the convex surface may be reversed, i.e. the convex surface may be provided on the holder base, while the concave surface may be provided on the center flexural plate to achieve the same desirable result of the present invention conformal disk holder.

While the intimate engagement between the convex surface and the concave surface allows at least a 5° tilt of the holder base from a horizontal plane, it is preferred that the intimate engagement allows a tilt between about 5° and about 30°, and preferably between about 10° and about 20° of the holder base from a horizontal plane.

Figure 1A:
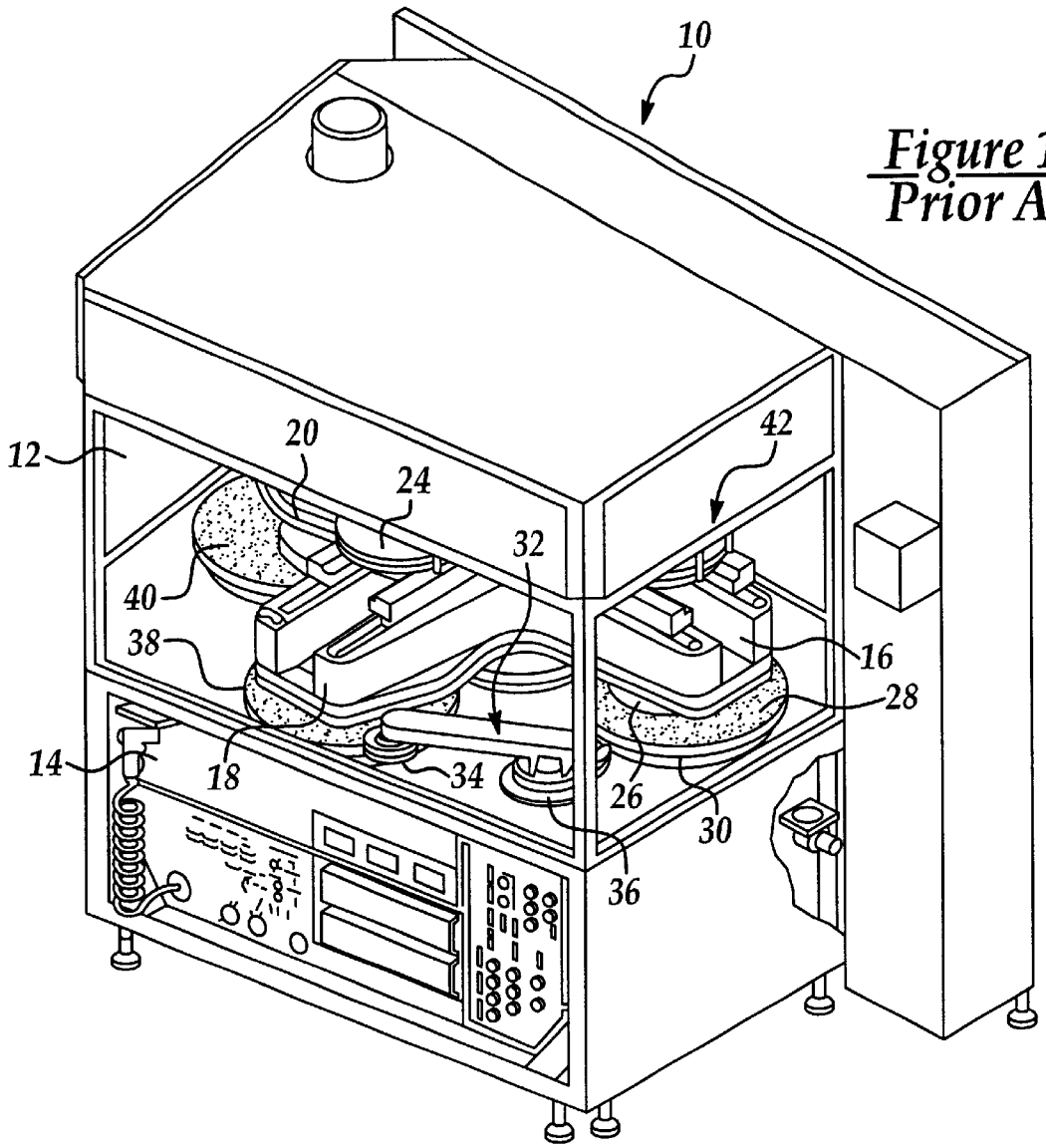
Figure 1A Prior Art
FIG. 1A is a perspective view of a convention chemical mechanical polishing apparatus enclosed in a control cabinet.
Figure 1B:
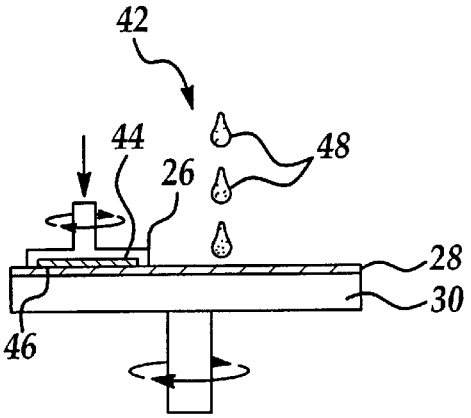
Figure 1B Prior Art
FIG. 1B is a cross-sectional view illustrating the relationship of a wafer carrier and a polishing platen.
Figure 1C:
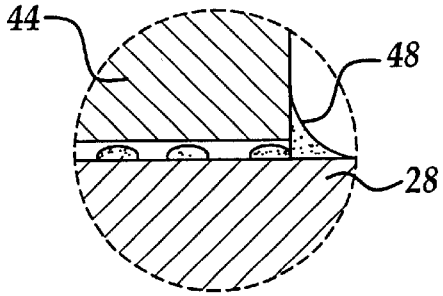
Figure 1C Prior Art
FIG. 1C is an enlarged, cross-sectional view illustrating slurry interaction between a wafer surface and a polishing pad surface.
Figure 2A:
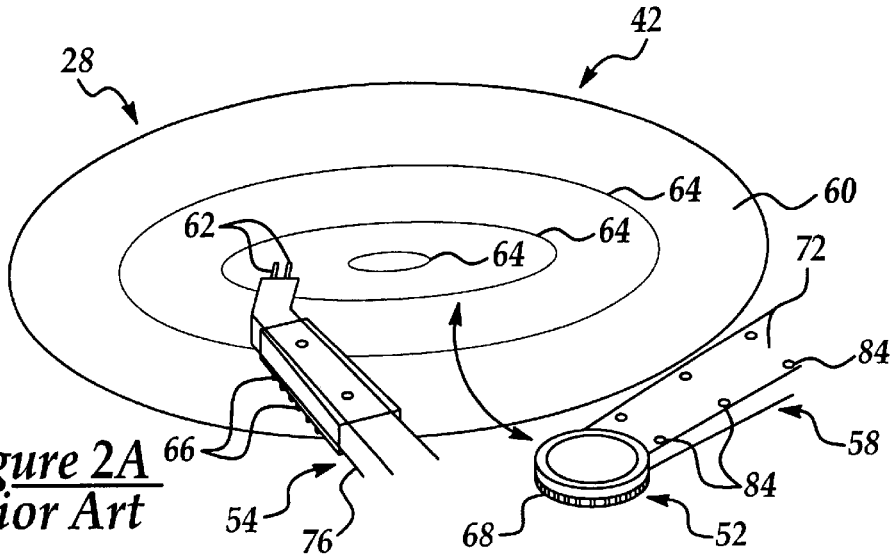
Figure 2A Prior Art
FIG. 2A is a perspective view of a polishing station equipped with a slurry dispensing head and a pad conditioning arm.
Figure 2B:
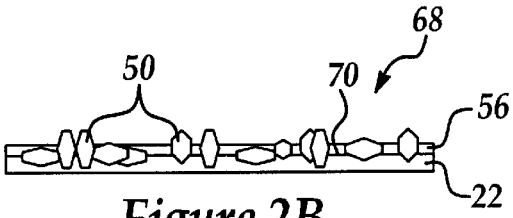
Figure 2B Prior Art
FIG. 2B is a cross-sectional view of a pad conditioning disk.
Figure 3A:
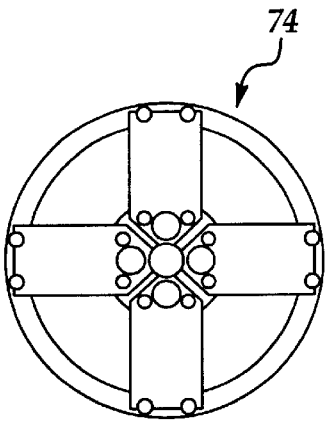
Figure 3A Prior Art
FIG. 3A is a plane view of a cross member in a conventional pad conditioning disk holder.
Figure 3B:
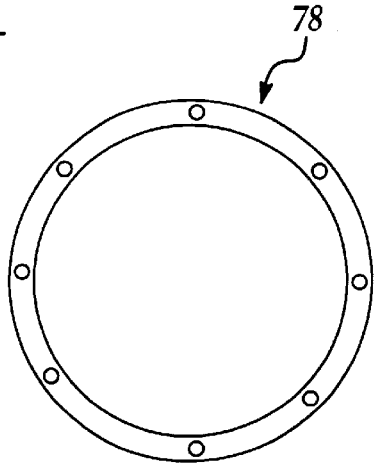
Figure 3B Prior Art
FIG. 3B is a plane view of a ring member in a conventional pad conditioning disk holder.
Figure 3C:
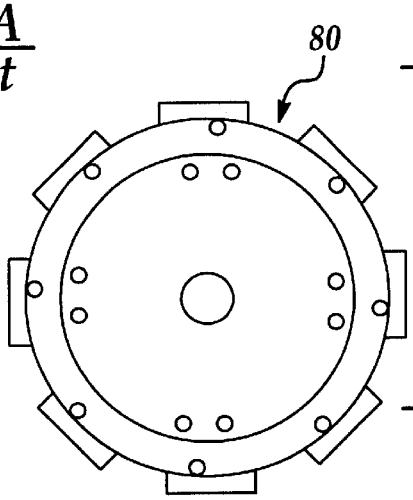
Figure 3C Prior Art
FIG. 3C is a plane view of a holder member in a conventional pad conditioning disk holder.
Figure 4A:
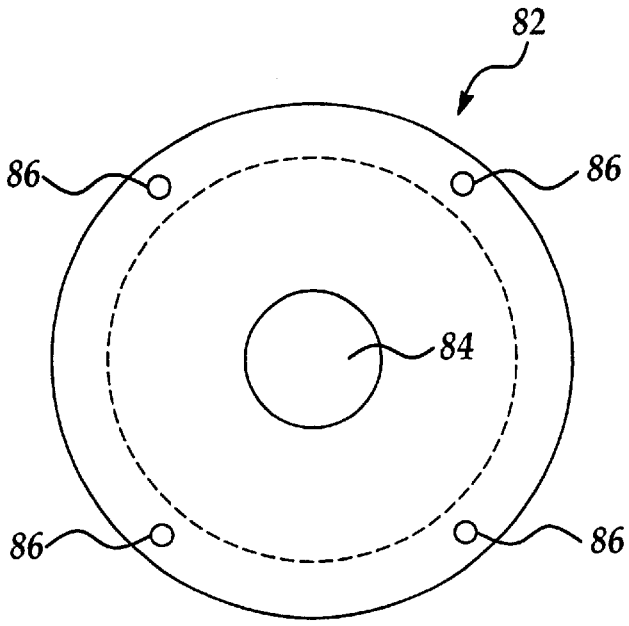
FIG. 4A is a plane view of a holder cover for a present invention pad conditioning disk holder.
Figure 4B:
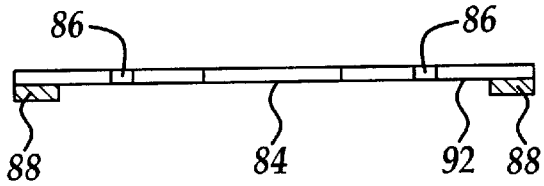
FIG. 4B is a cross-sectional view of the holder cover of FIG. 4A.

Referring now to FIGS. 4A and 4B, wherein a plane view and a cross-sectional view of a holder cover 82 for the present invention pad conditioning disk holder 100 (shown in FIG. 7) is shown, respectively. The holder cover 82 is formed in a circular shape with a first diameter, a center aperture 84 for accessing a flexural plate member 90, and a means for connecting to a rotating shaft (not shown). The cover member 84 is further provided with means, i.e. screw holes 86, for fastening to the base member 98, shown in FIGS. 6A and 6B. The cover member 82 is further provided with a downwardly protruding edge portion 88 on a bottom side 92 of the cover member 82. The cover member may be suitably fabricated of a rigid metal such as stainless steel.

Figure 5A:
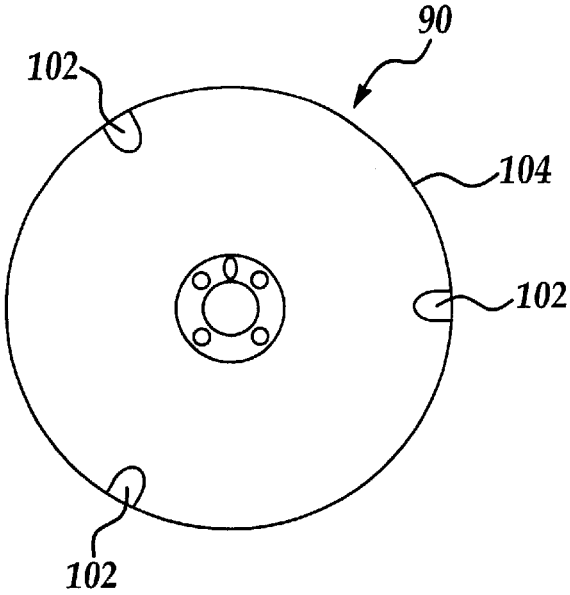
FIG. 5A is a plane view of a center flexural plate of the present invention pad conditioning disk holder.
Figure 5B:
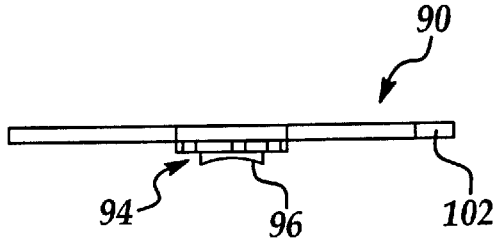
FIG. 5B is a cross-sectional view of the center flexural plate of FIG. 5A.
Figure 7:
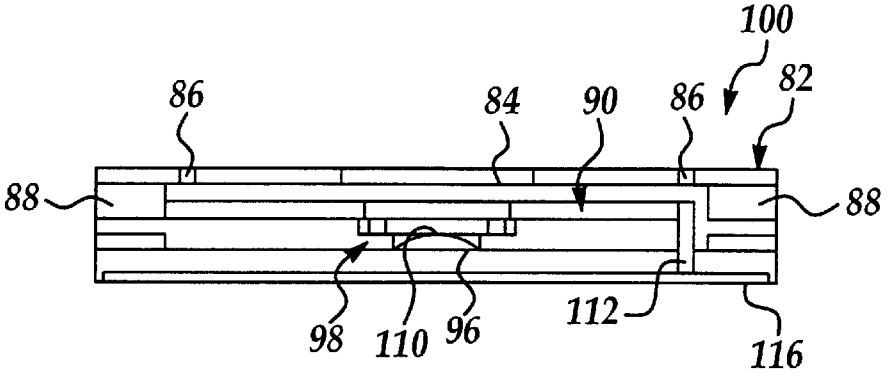
FIG. 7 is a cross-sectional view of the holder cover, the center flexural plate and the holder base of the present invention pad conditioning disk holder assembled together.

A flexural plate member 90 for the present invention pad conditioning disk holder 100 is shown in FIGS. 5A and 5B, in a plane view and in a cross-sectional view, respectively. The flexural plate member 90 is formed of circular shape and has a second diameter smaller than the first diameter of the cover member such that the flexural plate member 90 may be fitted inside the downwardly protruding edge portion 88 on the cover member 82. This is shown in FIG. 7. The flexural plate member 90 is equipped with a center protrusion 94 that has a downwardly facing convex surface 96 and at least three notch openings 102 provided equally spaced-apart along a peripheral edge 104 of the flexural plate member 90. The flexural plate member may also be formed of a stainless steel material that provides sufficient flexibility to allow the tilting of the base member attached thereto.

Figure 6A:
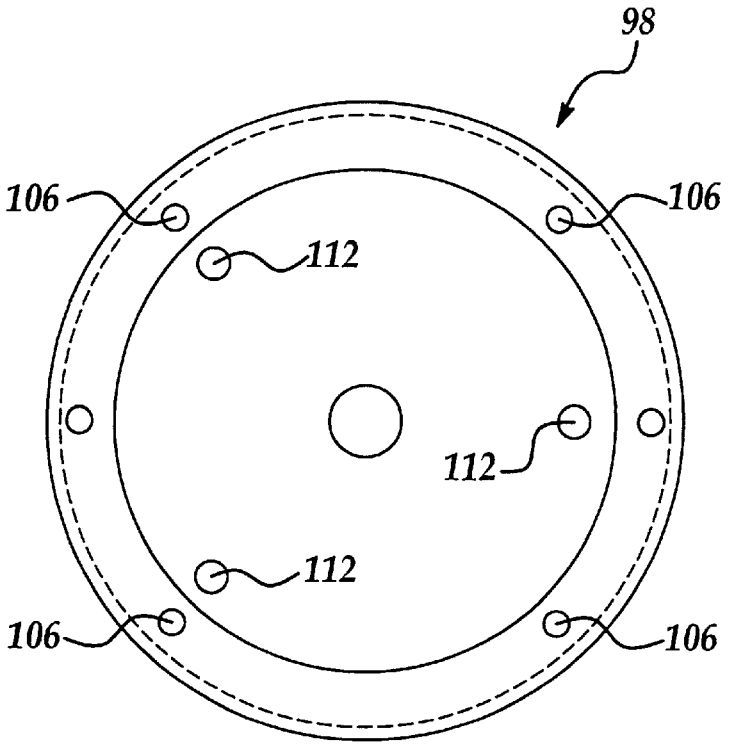
FIG. 6A is a plane view of a holder base of the present invention pad conditioning disk holder.
Figure 6B:
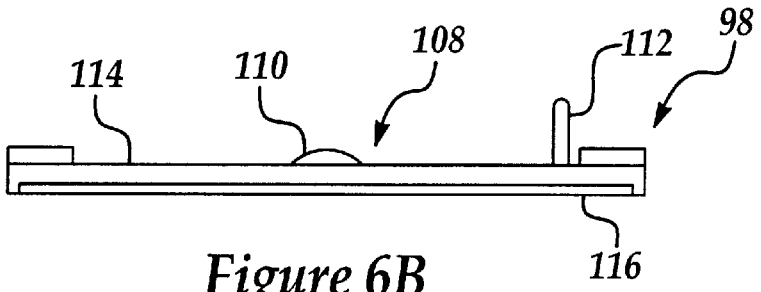
FIG. 6B is a cross-sectional view of the holder base of FIG. 6A.

A base member 98 for the present invention pad conditioning disk holder 100 is shown in FIGS. 6A and 6B, in a plane view and in a cross-sectional view, respectively. The base member 98 has the same diameter as the cover member 82 such that the two parts can be assembled together through screw holes 106 and 86. A center protrusion 108 with an upwardly facing concave surface 110 is adapted for intimately engaging the convex surface 96 on the center flexural plate 90 so as to allow a tilt of at least 5° of the base member 98 from a horizontal plane. The tilt may be possible between about 5° and about 30°, and preferably between about 10° and about 20°. The base member 98 may further include at least three locating pins 112 extending upwardly from a top surface 114 of the base member 98. The at least three locating pins 112 are adapted for engaging the at least three notch openings 102 in the flexural plate member 90, and yet allow the base member 98 to tilt freely to at least 5° or larger. The base member 98 is further provides means for fastening a conditioning disk (not shown) onto a bottom surface 116.

The present invention conformal disk holder for holding a rotating disk against a surface of a polishing pad, or for holding a CMP pad conditioning disk against a polishing pad surface has therefore been amply described in the above description and in the appended drawings of FIGS. 4A~7.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A conformal disk holder for holding a rotating disk against a surface comprising:

a holder cover of circular shape having a first diameter, a center aperture for accessing a center flexural plate, and a means for connecting a rotating shaft;

a center flexural plate of circular shape having a second diameter smaller than said first diameter for fitting inside a downwardly protruded edge portion on said holder cover; said center flexural plate being equipped with a center protrusion having a downwardly facing convex surface and at least three notch openings equally spaced-apart along a peripheral edge of the plate; and a holder base of circular shape having said first diameter and a center protrusion with an upwardly facing concave surface adapted for intimately engaging said convex surface on said center flexural plate so as to allow at least a 5° tilt of the holder base from a horizontal plane, said holder base further comprising at least three locating pins extending upwardly from a top surface of said holder base adapted for engaging said at least three notch openings in said center flexural plate, and means for fastening a disk onto a bottom surface of the holder base.

2. A conformal disk holder for holding a rotating disk against a surface according to claim 1, wherein said concave surface on said holder base allows a tilt between about 5° and about 30° of the holder base from a horizontal plane.

3. A conformal disk holder for holding a rotating disk against a surface according to claim 1, wherein said concave surface on said holder base allows a tilt preferably between about 10° and about 20° of the holder base from a horizontal plane.

4. A conformal disk holder for holding a rotating disk against a surface according to claim 1 further comprising a CMP conditioning disk mounted to said bottom surface of the holder base.

5. A conformal disk holder for holding a rotating disk against a surface according to claim 1, wherein said holder cover, said center flexural plate and said holder base are fabricated of stainless steel.

6. A conformal disk holder for holding a rotating disk against a surface according to claim 1, wherein said downwardly facing convex surface on the center flexural plate and said upwardly facing concave surface on the holder base have the same curvature.

7. A conformal disk holder for holding a rotating disk against a surface according to claim 1, wherein said conformal disk holder is adapted to follow the contour of a polishing pad surface in a CMP apparatus.

8. A conformal disk holder for holding a rotating disk against a surface according to claim 1, wherein said holder cover, said center flexural plate and said holder base are assembled together by mechanical means.

9. A conformal disk holder for holding a CMP pad conditioning disk comprising:

a cover member of circular shape having a first diameter, a center aperture for accessing a flexural plate member, and a means for connecting a rotating shaft;

a flexural plate member of circular shape having a second diameter smaller than said first diameter for fitting inside a downwardly protruded edge portion on said cover member; said flexural plate member being equipped with a center protrusion having a downwardly facing convex surface and at least three notch openings equally spaced-apart along a peripheral edge of the plate; and a base member of circular shape having said first diameter and a center protrusion with an upwardly facing concave surface adapted for intimately engaging said convex surface on said center flexural plate so as to allow a tilt between about 5° and about 30° of the base member from a horizontal plane, said base member further comprising at least three locating pins extending upwardly from a top surface of said base member adapted for engaging said at least three notch openings in said flexural plate member, and means for fastening a conditioning disk onto a bottom surface of the base member.

10. A conformal disk holder for holding a CMP pad conditioning disk according to claim 9 further comprising a CMP conditioning disk mounted to said bottom surface of the base member.

11. A conformal disk holder for holding a CMP pad conditioning disk according to claim 9, wherein said concave surface of said base member allows a tilt preferably between about 10° and about 20° of the holder base from a horizontal plane.

12. A conformal disk holder for holding a CMP pad conditioning disk according to claim 9, wherein said cover member, said flexural plate member and said base member are fabricated of stainless steel.

13. A conformal disk holder for holding a CMP pad conditioning disk according to claim 9, wherein said downwardly facing convex surface on said flexural plate member and said upwardly facing concave surface on said base member have the same curvature to allow an intimate engagement.

14. A conformal disk holder for holding a rotating disk against a surface according to claim 9, wherein said conformal disk holder is adapted to follow the contour of a polishing pad surface in a CMP apparatus.

15. A conformal disk holder for holding a rotating disk against a surface according to claim 9, wherein said cover member, said flexural plate member and said base member are assembled together by mechanical means.

16. A conformal disk holder for holding a CMP pad conditioning disk comprising:

a cover member of circular shape having a first diameter, a center aperture for accessing a flexural plate member, and a means for connecting a rotating shaft;

a flexural plate member of circular shape having a second diameter smaller than said first diameter for fitting inside a downwardly protruded edge portion on said cover member; said flexural plate member being equipped with a center protrusion having a downwardly facing concave surface and at least three notch openings equally spaced-apart along a peripheral edge of the plate; and a base member of circular shape having said first diameter and a center protrusion with an upwardly facing convex surface adapted for intimately engaging said concave surface on said center flexural plate so as to allow a tilt between about 5° and about 30° of the base member from a horizontal plane, said base member further comprising at least three locating pins extending upwardly from a top surface of said base member adapted for engaging said at least three notch openings in said flexural plate member, and means for fastening a conditioning disk onto a bottom surface of the base member.

17. A conformal disk holder for holding a CMP pad conditioning disk according to claim 16 further comprising a CMP conditioning disk mounted to said bottom surface of the base member.

18. A conformal disk holder for holding a CMP pad conditioning disk according to claim 16, wherein said concave surface of said base member allows a tilt preferably between about 10° and about 20° of the holder base from a horizontal plane.

19. A conformal disk holder for holding a CMP pad conditioning disk according to claim 16, wherein said downwardly facing concave surface on said flexural plate member and said upwardly facing convex surface on said base member have the same curvature to allow an intimate engagement.

20. A conformal disk holder for holding a CMP pad conditioning disk according to claim 16, wherein said cover member, said flexural plate member and said base member are fabricated of stainless steel.

* * * * *